US007648081B2

(12) United States Patent
Hagiwara et al.

(10) Patent No.: US 7,648,081 B2
(45) Date of Patent: Jan. 19, 2010

(54) CLEANING AND RELEASING DEVICE

(75) Inventors: Koichi Hagiwara, Ishikawa (JP); Jiro Watanabe, Ishikawa (JP)

(73) Assignee: Shibuya Kogyo Co., Ltd, Ishikawa (JP)

( * ) Notice: Subject to any disclaimer, the term of this patent is extended or adjusted under 35 U.S.C. 154(b) by 1005 days.

(21) Appl. No.: 10/006,568

(22) Filed: Dec. 10, 2001

(65) Prior Publication Data

US 2002/0088872 A1 Jul. 11, 2002

(30) Foreign Application Priority Data

Dec. 15, 2000 (JP) ..... P.2000-381741

(51) Int. Cl.
*B67D 5/38* (2006.01)

(52) U.S. Cl. ..... 239/74; 239/68; 239/304; 239/345; 239/413

(58) Field of Classification Search ..... 239/61, 239/62, 67, 68, 74, 302, 304, 307, 308, 345, 239/346, 347, 364, 365, 413, 417.5
See application file for complete search history.

(56) References Cited

U.S. PATENT DOCUMENTS

| | | | | |
|---|---|---|---|---|
| 2,980,339 | A * | 4/1961 | Bok et al. | 239/135 |
| 4,238,073 | A * | 12/1980 | Liska | 239/127 |
| 4,478,368 | A | 10/1984 | Yie | |
| 5,312,040 | A * | 5/1994 | Woodward | 239/1 |
| 5,551,909 | A | 9/1996 | Bailey | |
| 6,270,020 | B1 * | 8/2001 | Thompson et al. | 239/67 |

FOREIGN PATENT DOCUMENTS

| | | | |
|---|---|---|---|
| DE | 44 40 146 | A1 | 5/1996 |
| EP | 0 683 014 | A1 | 11/1995 |
| JP | 62-127305 | | 8/1987 |
| JP | 02-233162 | A | 9/1990 |
| JP | 3-166057 | | 7/1991 |
| JP | 10-156723 | | 6/1998 |
| JP | 11-104964 | A | 4/1999 |
| JP | 2000-024928 | A | 1/2000 |

OTHER PUBLICATIONS

Patent Abstract of Japan, 10-156723, Jun. 16, 1998.
Patent Abstract of Japan, 03-166057, Jul. 18, 1991.
Japanese Office Action dated Aug. 3, 2009.

* cited by examiner

*Primary Examiner*—Christopher S Kim
(74) *Attorney, Agent, or Firm*—Sughrue Mion, PLLC

(57) ABSTRACT

A cleaning and releasing device has a hand valve provided on a flow passage of a pressurized liquid in the vicinity of an injection nozzle, a switching valve 5 provided in a proper position on the flow passage of a pressurized gas, flow detecting means provided in a proper position on the flow passage of the pressurized liquid, and a controller for controlling the switching operation of the switching valve based on a result of detection transmitted from the flow detecting means, and controls the switching valve to supply and stop the pressurized gas depending on the presence of a flow of the liquid generated by the switching operation of the hand valve. The supply and stop of a powder and granular material may be controlled based on the result of detection transmitted from the flow detecting means.

7 Claims, 4 Drawing Sheets

CLEANING AND RELEASING DEVICE

The present application is based on Japanese Patent Application No. 2000-381741, which is incorporated herein by reference.

BACKGROUND OF THE INVENTION

1. Field of the Invention

The present invention relates to a cleaning and releasing device for carrying out a cleaning and/or releasing work by spraying, onto an object to be cleaned, a gas-liquid mixed flow injected from an injection nozzle or a jet flow having a powder and granular material added thereto. More particularly, the invention relates to control of supply and stop of a pressurized gas or a powder and granular material to the injection nozzle.

2. Description of the Related Art

In a cleaning and releasing device for mixing a pressurized liquid and a pressurized gas through an injection nozzle to form a gas-liquid mixed flow and spraying the gas-liquid mixed flow onto an object to be cleaned, thereby carrying out a cleaning and releasing work, generally, mechanical valves for the pressurized gas and the pressurized liquid are provided in the injection nozzle portion and an injection and stop operation from the injection nozzle is carried out through the operations of the valves. Furthermore, there has been widely known a method of additionally providing a device for feeding a powder and granular material and a wireless or wire remote controller for operating a valve to supply the powder and granular material in the injection nozzle portion and for controlling the supply and stop of the powder and granular material through a remote operation when the powder and granular material is to be used. In the conventional art, however, the injection nozzle portion is provided with the mechanical valves for both the pressurized liquid and the pressurized gas or the remote controller for the powder and granular material. Therefore, there has been a technical difficulty in that the injection nozzle portion becomes complicated and large-sized, and furthermore, a weight thereof is also increased. In the case of the wireless remote controller, furthermore, there has also been a problem in that a distance at which transmission can be carried out is approximately 20 meters at most, a length to the injection nozzle is restricted and a malfunction is easily caused. In the case of the wire remote controller, moreover, operability and disconnection have made troubles.

Furthermore, there has also been disclosed technical means for providing a control valve for air for a signal in an injection nozzle portion and a supply control valve related to a pressurized gas and a powder and granular material is operated remotely (Unexamined Japanese Patent Publication No. Hei. 3-166057). Also in the conventional art, however, it has been necessary to provide a pipe line of air for a signal and a control valve thereof in the injection nozzle portion. Therefore, there has been a technical difficulty that the injection nozzle portion becomes complicated and large-sized, and furthermore, a weight is also increased. Moreover, there has also been disclosed a technique in which a switch for interlocking with a trigger is provided in the injection nozzle portion and a supply timing or a stop timing of a liquid and a powder and granular material for the injection nozzle is controlled by operating the switch and setting a timer, thereby setting the supply timing of the powder and granular material at the start of injection to be later than that of the liquid or setting the stop timing of the liquid at the time of the stop of the injection to be later than that of the powder and granular material (Unexamined Japanese Patent Publication No. Hei. 10-156723).

In consideration of the problems of the conventional art, the invention has been made and has an object to reduce the number of operating means such as a hand valve to be provided in an injection nozzle portion, to simplify the structure of the injection nozzle portion and to enhance operability in a cleaning and releasing device of such a type as to supply a pressurized liquid and a pressurized gas to an injection nozzle, such a type as to supply a powder and granular material or such a type as to suck a gas through a jet flow of a pressurized liquid supplied to the injection nozzle and to supply the powder and granular material.

In order to solve the problems, the invention employs technical means, that is, a cleaning and releasing device for spraying a jet flow from an injection nozzle onto an object to be cleaned, thereby carrying out a cleaning and/or releasing work, wherein operating means for operating supply and stop of a pressurized liquid to the injection nozzle is provided in the injection nozzle or in the vicinity thereof and detecting means for detecting the supply and stop of the pressurized liquid generated by the operation of the operating means is provided in a proper position on a flow passage of the pressurized liquid, supply and stop of a pressurized gas to the injection nozzle being controlled based on a result of the detection. More specifically, there can be provided a hand valve provided on the flow passage of the pressurized liquid in the injection nozzle or in the vicinity thereof and serving to supply and stop the pressurized liquid to the injection nozzle, a switching valve provided in a proper position on the flow passage of the pressurized gas and serving to supply and stop the pressurized gas to the injection nozzle, flow detecting means provided in a proper position on the flow passage of the pressurized liquid and serving to detect presence of a flow of the liquid, and a controller for controlling a switching operation of the switching valve based on a result of the detection transmitted from the flow detecting means, wherein the switching valve is controlled to supply and stop the pressurized gas depending on the presence of the flow of the pressurized liquid generated by a switching operation of the hand valve. Moreover, there can be so constituted that when powder and granular supply means is provided on the flow passage of the pressurized gas to supply the powder and granular material, the supply and stop of the powder and granular material is controlled based on a result of detection related to the supply and stop of the pressurized liquid to the injection nozzle. Furthermore, there can be so constituted that when the powder and granular material is to be used, the supply of the pressurized gas is started based on detection of the supply of the pressurized liquid to the injection nozzle when injection is to be started and the supply of the powder and granular material is stopped and the supply of the pressurized gas is stopped after a predetermined time passes based on the detection of the stop of the pressurized liquid to the injection nozzle when the injection is to be stopped.

Moreover, there is employed such technical means that in such a type as to suck a gas through a jet flow of a pressurized liquid supplied to an injection nozzle and to spray a jet flow formed by supplying a powder and granular material in a proper process onto an object to be cleaned, thereby carrying out a cleaning and/or releasing work, operating means for operating supply and stop of a pressurized liquid is provided in the injection nozzle or in the vicinity thereof and detecting means for detecting the supply and stop of the pressurized liquid generated by the operation of the operating means is provided in a proper position on a flow passage of the pressurized liquid, supply and stop of the powder and granular material being controlled based on a result of the detection.

Features and advantages of the invention will be evident from the following detailed description of the preferred embodiments described in conjunction with the attached drawings.

DETAILED DESCRIPTION OF THE PREFERRED EMBODIMENTS

The invention is applied to a cleaning and releasing device of such a type as to supply a pressurized liquid and a pressurized gas to an injection nozzle, such a type as to supply the powder and granular material or such a type as to suck a gas through a jet flow of a pressurized liquid supplied to the injection nozzle and to supply a powder and granular material. More specifically, the invention can be widely applied to any cleaning and releasing device for spraying, onto an object to be cleaned, a jet flow obtained by supplying at least a pressurized liquid to an injection nozzle to carry out a cleaning and/or releasing work irrespective of the size of the device or the kind of the object to be cleaned. The cleaning and releasing device according to the invention includes devices having various configurations, for example, a device capable of selectively executing an optional working configuration including a working configuration in which a cleaning function is mainly carried out and a working configuration in which a releasing function is mainly carried out, a device for mainly carrying out the cleaning function or a device for mainly carrying out the releasing function. Referring to the pressurized liquid, moreover, it is possible to use a proper liquid such as water or a detergent depending on circumstances. Moreover, air is generally used for the pressurized gas and other gases such as vapor can also be used. The pressure and flow of the pressurized liquid or the pressurized gas can be set depending on circumstances, and pressurizing means suitable for the setting is selected. It is also possible to directly supply the pressurized liquid from waterworks to the injection nozzle. Furthermore, the powder and granular material is not restricted to the kind or particle size thereof but a proper powder and granular material such as garnet or sodium hydrogencarbonate can be used depending on circumstances.

Figure 4:
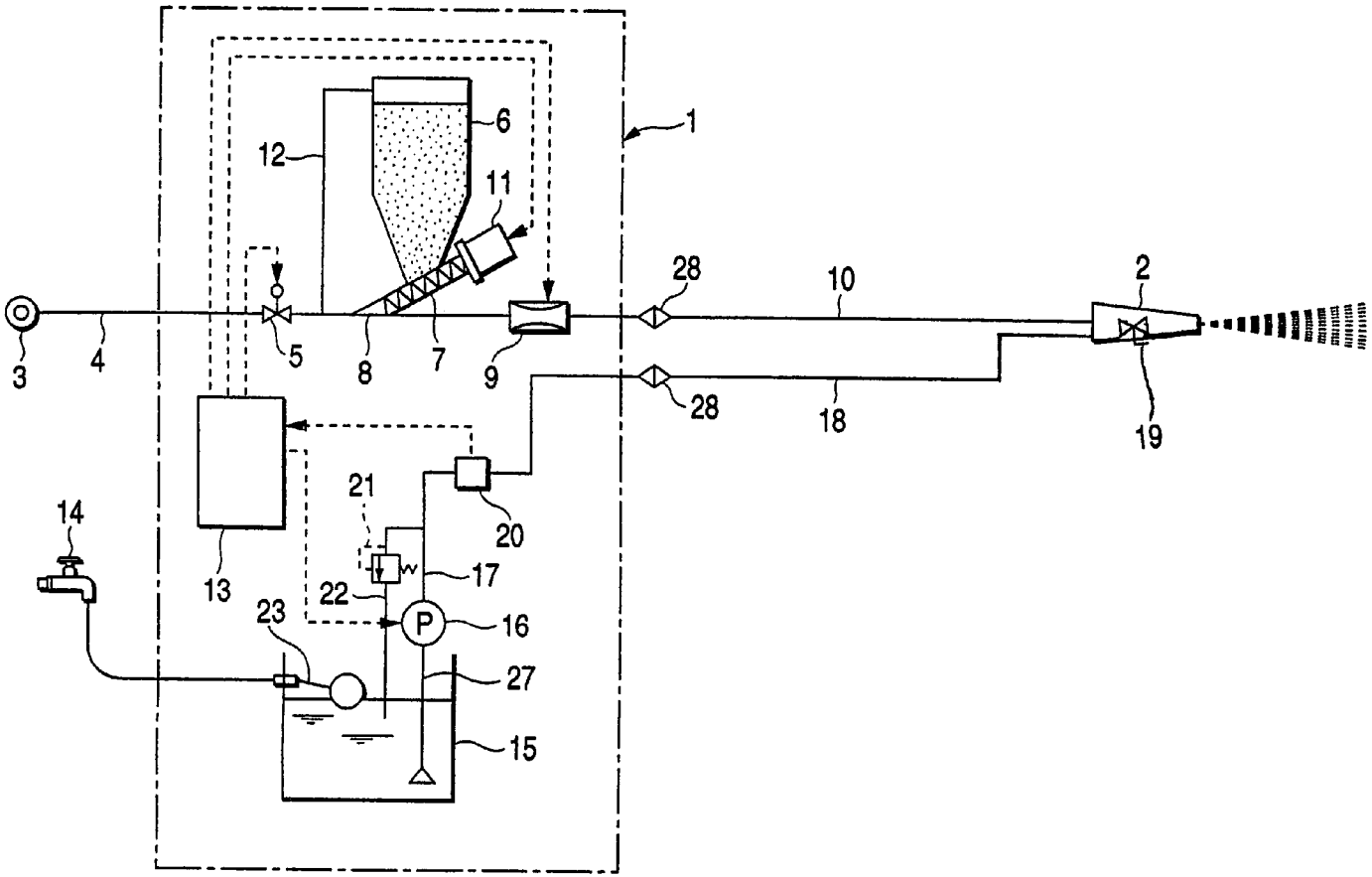
FIG. 4 is a view showing the structure of a circuit, illustrating main parts according to an embodiment of the invention.

An injection nozzle to be used can have a proper configuration such as a configuration in which a pressurized gas and a pressurized liquid are mixed in an injection nozzle or the outlet of an injection port to form a droplet flow and to inject the droplet flow toward an object to be cleaned or a configuration in which a gas is sucked by the ejector effect through the jet flow of the pressurized liquid to form and inject a gas-liquid mixed flow. An operating portion of a hand valve such as a mechanical valve or an operating switch portion of an electromagnetic valve corresponds to operating means for operating the supply and stop of the pressurized liquid to the injection nozzle and is provided in an injection nozzle portion or in the vicinity thereof such that the operation can easily be carried out. See, for example, FIGS. 4 and 1. However, detecting means for detecting the supply and stop of the pressurized liquid and a switching valve for supplying and stopping the pressurized gas to the injection nozzle can be provided in proper positions on a flow passage for the pressurized liquid or the pressurized gas depending on circumstances. As described above, according to the invention, it is sufficient that the operating means for operating the supply and stop of the pressurized liquid to the injection nozzle is provided in the injection nozzle portion or in the vicinity thereof. Therefore, it is possible to reduce the number of the operation means such as a hand valve to be provided in the injection nozzle portion or in the vicinity thereof, to simplify the structure of the injection nozzle portion and to decrease a weight. A valve mechanism related to the hand valve and the switching valve which has at least a supply and stop function can be used with various configurations. Moreover, a control configuration for executing the supply and stop of the pressurized gas or the powder and granular material based on the result of detection related to the supply and stop of the pressurized liquid to the injection nozzle includes an indirect control configuration in which a predetermined time lag is provided based on the result of detection to execute the supply and stop in addition to a control configuration in which the supply and stop of the pressurized gas or the powder and granular material is immediately executed based on the result of detection. Furthermore, flow detecting means for detecting the presence of the flow of the liquid can preferably detect the presence of the flow of the pressurized liquid as a result, and it is possible to employ proper detecting means such as means for detecting the flow based on a pressure value in addition to means for detecting the flow itself.

Figure 1:
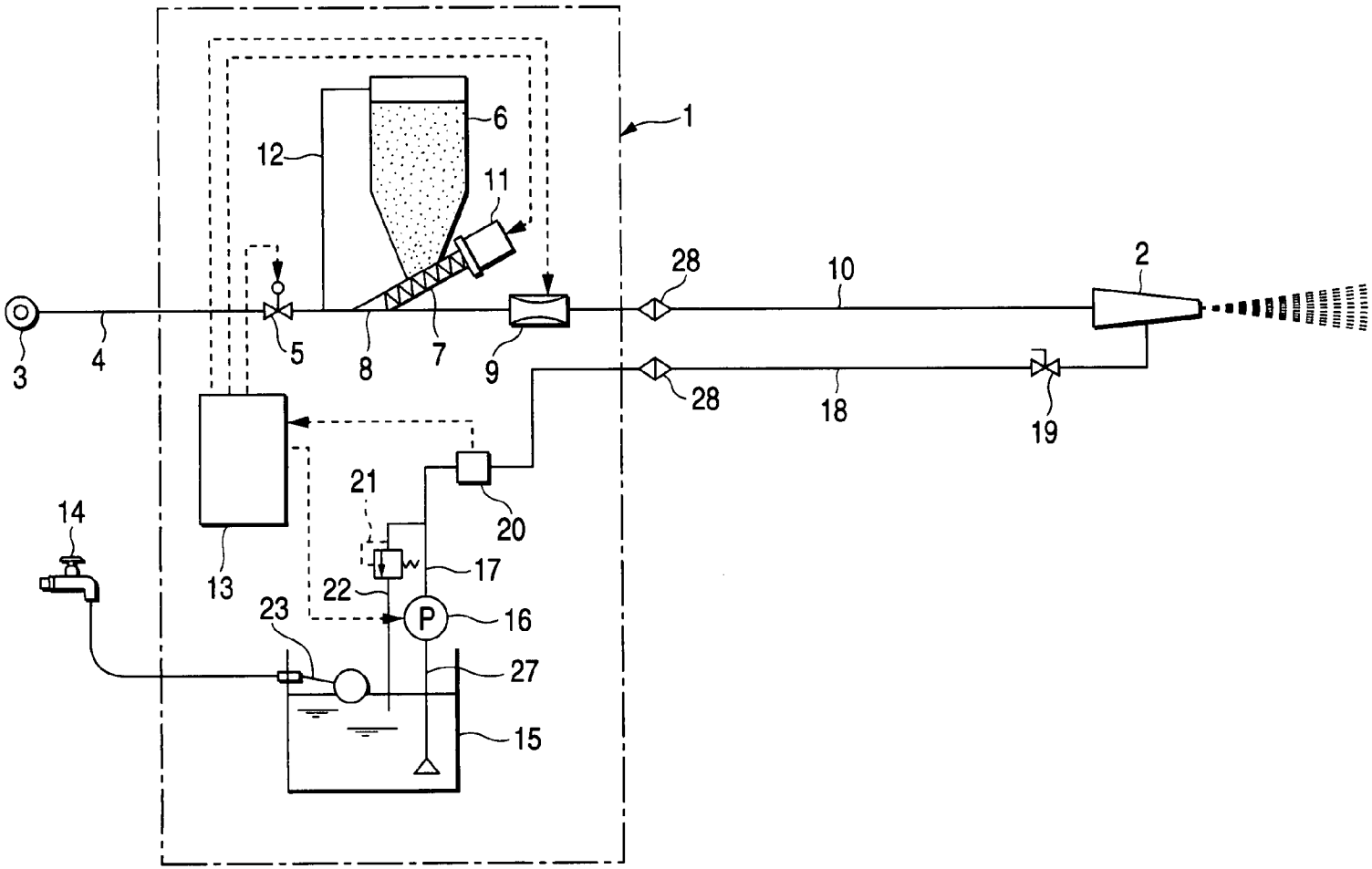
FIG. 1 is a view showing the structure of a circuit, illustrating main parts according to an embodiment of the invention.

An embodiment of the invention will be described below with reference to the drawings. FIG. 1 is a view showing the structure of a circuit, illustrating main parts according to an embodiment of the invention. In the drawing, 1 denotes a cleaning and releasing device body according to the embodiment and 2 denotes an injection nozzle connected to the device body 1 through a hose. The device body 1 is provided with a pressurized gas supply pipe (pressurized gas supply passage) 4 connected to a pressurized gas source 3 connected to a compressor which is not shown. An injecting portion 8 to be powder and granular material supply means including a powder and granular material tank 6 and a screw type feeding device 7 is connected in the middle of the pressurized gas supply pipe 4 at the downstream side of a switching valve 5 for supply and stop of a pressurized gas which includes an electromagnetic valve. Furthermore, a pinch valve 9 is provided on the downstream side of the injecting portion 8 for a powder and granular material fed from the feeding device 7 and is connected to the injection nozzle 2 through a supply hose (pressurized gas supply passage) 10 for the pressurized gas. In the drawing, 11 denotes a driving motor of the feeding device 7 and 12 denotes a pre-pressurizing pipe guided to the upper surface of a powder and granular material in the powder and granular material tank 6. The switching valve 5, the pinch valve 9 and the driving motor 11 are constituted to be controlled by a controller 13, respectively. Reference numeral 28 designates-couplers for connecting supply hoses 10,18 to the device body 1.

Furthermore, the device body 1 is provided with a liquid tank 15 connected to a liquid source 14 such as waterworks and is constituted to pressurize a liquid in the liquid tank 15 by a pump 16 connected to the liquid tank 15 through a liquid supply passage 27 and to supply the pressurized liquid to the injection nozzle 2 through a pressurized liquid supply pipe (pressurized liquid flow passage) 17 and the supply hose (pressurized liquid flow passage) 18. As shown, a hand valve 19 comprising a mechanical valve is provided in the vicinity of the injection nozzle 2 of the supply hose 18 for the pressurized liquid and flow detecting means (sensor such as flow switch, flow meter, pressure switch, etc.) 20 is provided in a proper position on the upstream side thereof. If the mechanical valve is employed for the hand valve 19, the structure is excellent in that a wiring is not required. If the operating switch of the electromagnetic valve is provided in the injection nozzle 2 portion in place of the hand valve 19 and the electromagnetic valve itself is: provided in another portion, the injection nozzle 2 can further be simplified and a weight thereof can be reduced. In the drawing, 21 denotes a relief valve provided between the pump 16 and the flow detecting means 20, 22 denotes a return pipe thereof and 23 denotes a ball tap. The result of detection obtained by the flow detecting means 20 is transmitted to the controller 13 through a signal line. Moreover, the pump 16 is constituted to be operatively controlled by the controller 13. Incidentally, although the flow detecting means 20 is disposed on the pressurized liquid supply pipe 17 in this embodiment, it can be disposed on the liquid supply passage 27.

Figure 2:
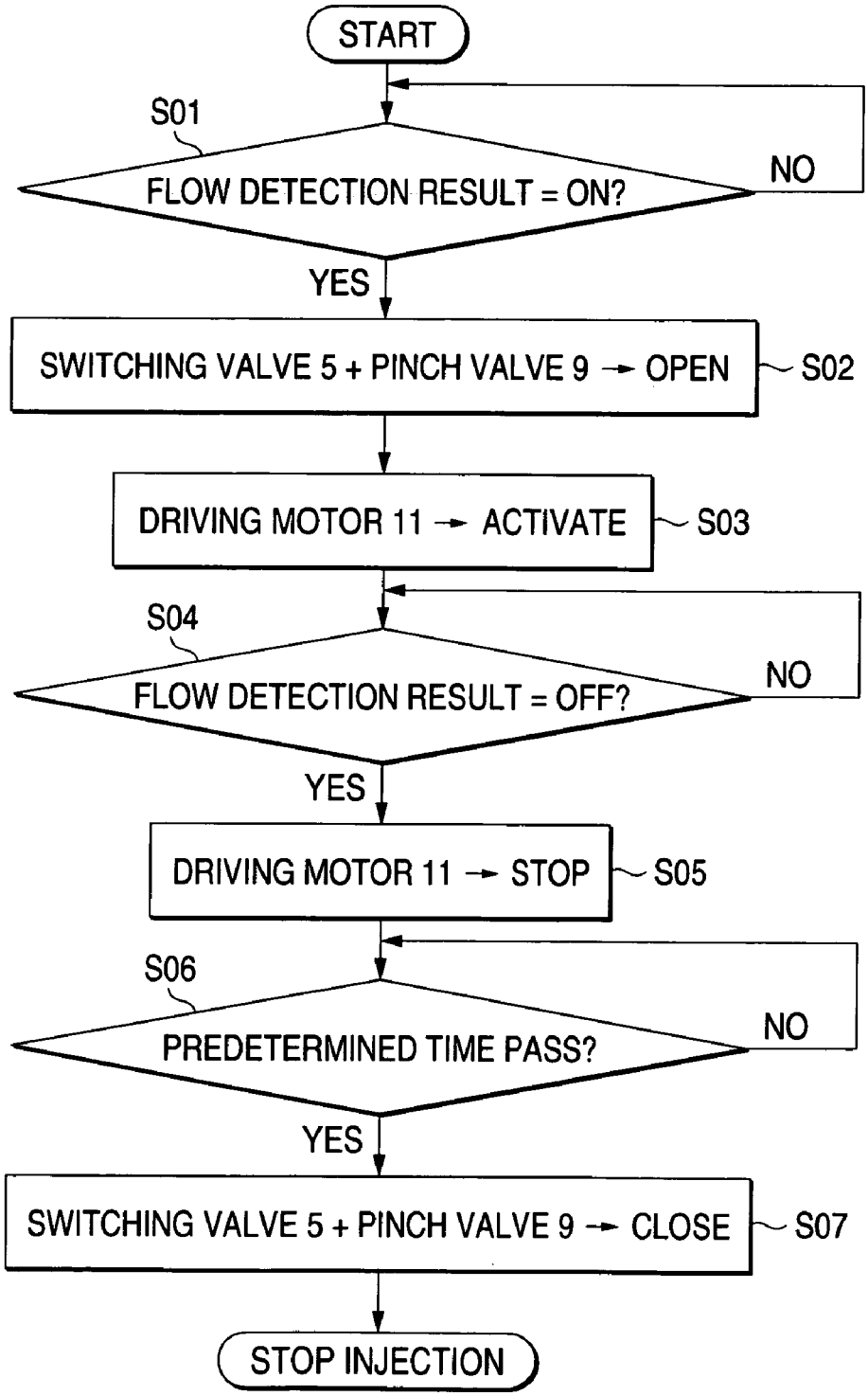
FIG. 2 is a flow chart showing a control flow according to the embodiment.

Next, the operation according to the embodiment will be described with reference to a control flow chart of FIG. 2. When a power switch is first turned on, the pump 16 is operated to suck up and pressurize a liquid in the liquid tank 15 through the liquid supply passage 27. As a result, when the downstream side of the pump 16 reaches a predetermined pressure value, the relief valve 21 is operated so that an extra liquid is returned into the liquid tank 15 through the return pipe 22 to hold a predetermined pressure. At the start of the flow chart in FIG. 2, the operation state of the pump 16 is set. At Step S01, the result of detection transmitted from the flow detecting means 20 to the controller 13 is monitored. While the result of detection transmitted from the flow detecting means 20 is OFF, that is, the flow of a pressurized liquid is not detected but supply is stopped, the monitoring operation is continuously carried out. Then, when the hand valve 19 is opened, the pressurized liquid is supplied to the injection nozzle 2 and the flow of the pressurized liquid is detected by the flow detecting means 20 and is transmitted to the controller 13. Consequently, the result of detection transmitted from the flow detecting means 20 at the Step S01 is turned ON and the process proceeds to Step S02 where the switching valve 5 and the pinch valve 9 are opened to start the supply of a pressurized gas. Thereafter, the process proceeds to Step S03 where the driving motor 11 is started to supply a powder and granular material. A proper time lag may be set between the Step S02 and the Step S03.

As described above, when the hand valve 19 is opened to supply a pressurized liquid to the injection nozzle 2, the flow of the pressurized liquid is detected by the flow detecting means 20, the switching valve 5 and the pinch valve 9 are automatically opened and the driving motor 11 is started based on the result of detection, and the supply of the pressurized gas and the powder and granular material to the injection nozzle 2 can be started automatically. In the injection nozzle 2, thus, the pressurized liquid thus supplied and the pressurized gas containing the powder and granular material are mixed to form a droplet-like jet flow and spray the jet flow onto an object to be cleaned. Consequently, a cleaning and releasing work can be carried out. The cleaning and releasing work described above is continuously carried out until the hand valve 19 is closed and the supply of the pressurized liquid is stopped.

When the hand valve 19 is closed to stop the supply of the pressurized liquid, the stop of the supply of the pressurized liquid is detected by the flow detecting means 20 and is transmitted to the controller 13. Consequently, the result of detection transmitted from the flow detecting means 20 at Step S04 becomes OFF and the conditions are satisfied to proceed to Step S05 where the driving motor 11 is stopped to stop the supply of the powder and granular material. As a result, only the pressurized gas is supplied to the injection nozzle 2. In the operation state, accordingly, the powder and granular material remaining in the pressurized gas supply pipe 4, the pinch valve 9, the supply hose 10 and the injection nozzle 2 which act as flow passages for the pressurized gas is discharged together with the pressurized gas. The operation state in which only the pressurized gas is supplied is continuously maintained for a predetermined sufficient time for discharging the residual powder and granular material. If it is decided that the predetermined time has passed at Step S06, the process proceeds to Step S07 where the switching valve 5 and the pinch valve 9 are closed to stop the supply of the pressurized gas and the injection from the injection nozzle 2 is completely stopped. Thus, the cleaning and releasing work is ended.

When the hand valve 19 is closed to stop the supply of the pressurized liquid to the injection nozzle 2 as described above, the stop of the flow of the pressurized liquid is detected by the flow detecting means 20, the driving motor 11 is stopped based on the result of detection and the supply of the powder and granular material is automatically stopped. Then, the operation state in which only the pressurized gas is supplied is continuously maintained for the predetermined sufficient time for discharging the residual powder and granular material, and the switching valve 5 and the pinch valve 9 are then closed automatically and the supply of the pressurized gas is stopped so that the cleaning and releasing work is completely ended automatically.

Figure 3:
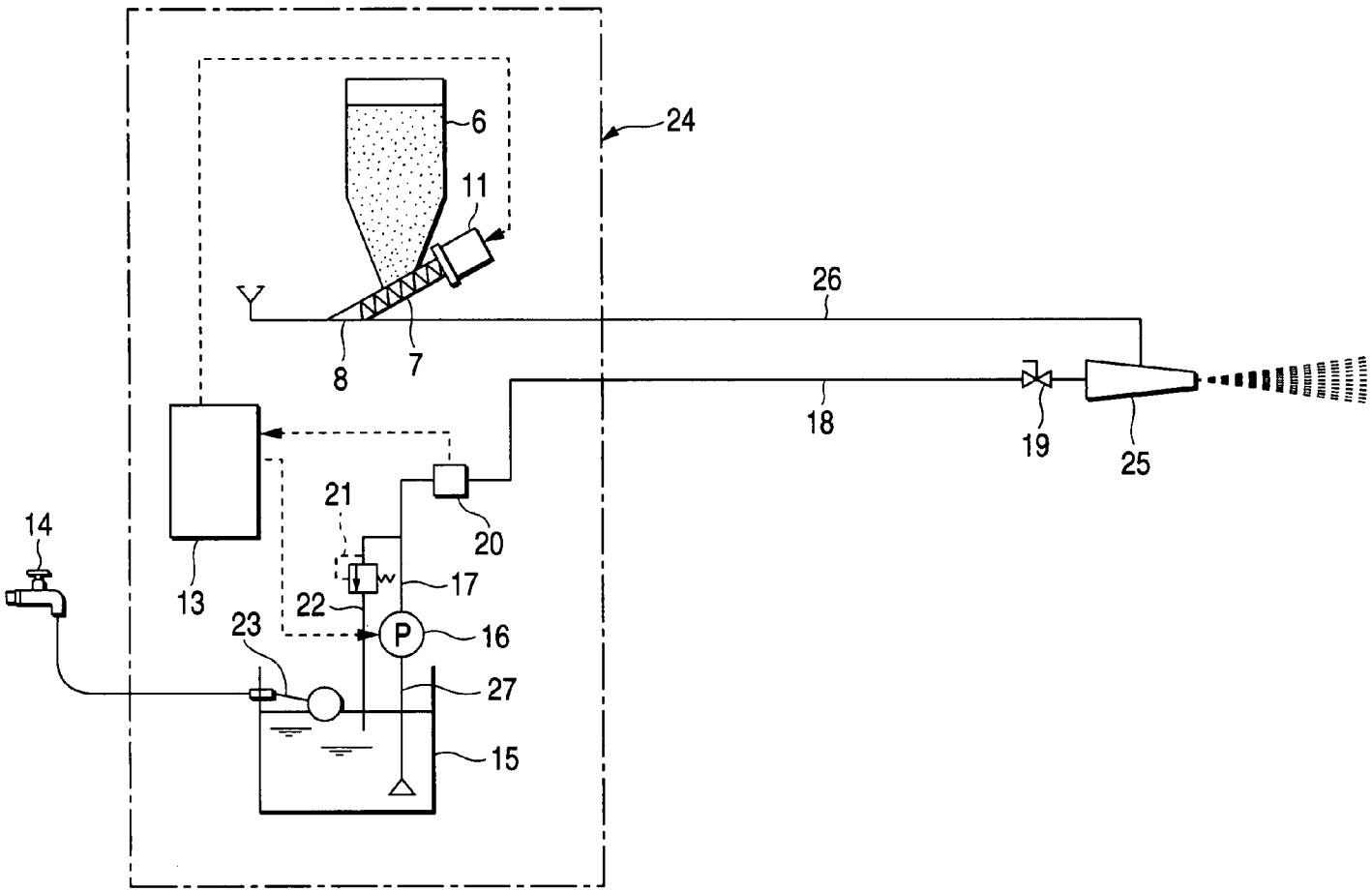
FIG. 3 is a view showing the structure of a circuit, illustrating main parts according to another embodiment of the invention.

FIG. 3 is a view showing the structure of a circuit, illustrating main parts according to another embodiment of the invention. In the embodiment, the supply of a gas to an injection nozzle is carried out by a sucking function based on the ejector effect through the jet flow of a pressurized liquid. As shown, the structure of the circuit according to the embodiment has many portions common to the structure of the circuit shown in FIG. 1. Therefore, the same components have the same reference numerals and the above description will be quoted. The embodiment is different from the above embodiment in that the upstream side end of a gas supply hose (air supply passage) 26 connecting an injecting portion 8 to be powder and granular supply means including a powder and granular material tank 6 and a screw type feeding device 7 which is an element of a cleaning and releasing device body 24 and an injection nozzle 25 is opened to the atmosphere. More specifically, the embodiment has such a structure that the injection nozzle 25 sucks air from the atmosphere through the supply hose 26 to inject a gas-liquid mixed flow by a sucking function based on the ejector effect when injecting a pressurized liquid supplied through a supply hose 18. Moreover, when the air is to be sucked through the supply hose 26, a powder and granular material is injected through the injecting portion 8 of the powder and granular material supply means and is supplied as a gas containing the powder and granular material to the injection nozzle 25.

When the hand valve 19 is opened so that the supply of the pressurized liquid to the injection nozzle 25 is started to begin the injection, the air is sucked and is supplied to the injection nozzle 25 through the supply hose 26 based on the ejector effect of the jet flow of the pressurized liquid as described above. When the supply of the pressurized liquid is detected by the flow detecting means 20 with the start of the supply of the pressurized liquid, the driving motor 11 is started to be driven to start the supply of the powder and granular material in response to a command sent from the controller 13 immediately or with a predetermined time lag based on the result of detection. Consequently, a gas-liquid mixed flow containing the powder and granular material is injected as a jet flow for cleaning from the injection nozzle 25 so that the usual cleaning and releasing function is executed. When the cleaning and releasing work is completed to close the hand valve 19 and the supply of the pressurized liquid to the injection nozzle 25 is stopped, the result of detection is transmitted from the flow detecting means 20 to the controller 13. In the controller 13, the driving motor 11 is stopped to stop the supply of the powder and granular material based on the result of detection. In the embodiment, it is apparent that the action for sucking a gas is ended with the stop of the supply of the pressurized liquid. Referring to the supply pipe for the pressurized liquid, the pressurized gas or the sucked gas, the supply hoses 10, 18 and 26 may be extended into the device bodies 1 and 24 for use or another supply pipe such as a steel pipe may be used for the inside of the device bodies 1 and 24 and the supply hoses 10, 18 and 26 may be connected to the outside of the device bodies 1 and 24 for use depending on circumstances.

According to the invention, the supply and stop of the pressurized liquid to the injection nozzle is detected and the supply and stop of the pressurized gas or the powder and granular material is controlled based on the result of detection. Therefore, the following effects can be obtained.

It is sufficient that operating means for operating the supply and stop of the pressurized liquid is provided in the injection nozzle or in the vicinity thereof. Therefore, it is possible to reduce the number of operating means to be provided in the injection nozzle or in the vicinity thereof.

Accordingly, the structure of the injection nozzle portion can be simplified, and furthermore, a size can be reduced and a weight can be decreased. Consequently, the operability of the injection nozzle can be enhanced.

In the case in which the powder and granular material is to be used, the supply and stop of the powder and granular material can be simply automated based on the result of detection.

By employing the hand valve, the supply hose is simply extended so that a length between the device body and the injection nozzle can be easily increased without a conventional hindrance.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A cleaning and releasing device for spraying a jet flow onto an object to be cleaned, comprising:

an injection nozzle which mixes a pressurized liquid and a pressurized gas in said injection nozzle and injects the pressurized liquid and the pressurized gas;

a pressurized liquid flow passage for supplying the pressurized liquid to said injection nozzle;

a pressurized gas flow passage for supplying the pressurized gas to said injection nozzle;

operating means for supplying and stopping the pressurized liquid to said injection nozzle, said operating means being provided in said injection nozzle or on the flow passage of the pressurized liquid in communication with said injection nozzle;

detecting means for detecting supply and stop of the pressurized liquid generated by an operation of said operating means, said detecting means being provided in a position on said pressurized liquid flow passage;

a switching valve provided in the flow passage of the pressurized gas and serving to supply and stop the pressurized gas to said injection nozzle; and a controller for controlling a switching operation of said switching valve based on a detection signal transmitted from the detecting means;

wherein the controller opens said switching valve based on a detection signal transmitted from the detecting means so as to supply the pressurized gas to said injection nozzle when the injection of the pressurized liquid from said injection nozzle is detected by said detecting means; and wherein the controller closes said switching valve based on a detection signal transmitted from the detecting means so as to stop the supply of the pressurized gas to said injection nozzle when the stop of the injection of the pressurized liquid from said injection nozzle is detected by said detecting means.

2. A cleaning and releasing device according to claim 1, further comprising powder and granular supply means being provided on a flow passage of the pressurized gas, and supply and stop of the powder and granular material is controlled based on a result of the detection related to the supply and stop of the pressurized liquid to said injection nozzle.

3. A cleaning and releasing device according to claim 2, wherein the supply of the pressurized gas is started and the supply of the powder and granular material is started based on the detection of the supply of the pressurized liquid to said injection nozzle when injection is to be started, the supply of the powder and granular material is stopped and the supply of the pressurized gas is stopped after a predetermined time passes based on the detection of the stop of the pressurized liquid to said injection nozzle when the injection is to be stopped.

4. A cleaning and releasing device comprising:

a liquid tank for storing liquid;

a pump for pressurizing the liquid in said liquid tank to supply pressurized liquid;

a liquid supply passage for connecting said liquid tank to said pump;

an injection nozzle for injecting the pressurized liquid;

a pressurized liquid flow passage for connecting said pump to said injection nozzle;

a pressurized gas source;

a pressurized gas supply passage for connecting said pressurized gas source to said injection nozzle;

a switching valve provided on said pressurized gas supply passage;

a sensor provided on said pressurized liquid flow passage to detect supply and stop of the pressurized liquid from said liquid tank;

an operating portion disposed in said injection nozzle or on said pressurized liquid flow passage to thereby supply and stop the pressurized liquid; and a controller connected to said sensor and said pressurized gas supply passage, said controller detecting supply and stop of the pressurized liquid detected by said sensor to thereby control supply and stop of the pressurized gas from said pressurized gas supply passage to said injection nozzle based on a detection signal of said sensor;

wherein pressurized gas is supplied to said injection nozzle from said pressurized gas supply passage when said sensor detects the supply of the pressurized liquid from said liquid tank.

5. A cleaning and releasing device according to claim 4, further comprising a powder and granular material tank connected to said pressurized gas supply passage, and supply and stop of powder and granular material is controlled by said controller based on the supply and stop of the pressurized liquid detected by said sensor.

6. A cleaning and releasing device according to claim 4, wherein the controller controls the supply and stop of the pressurized gas by opening and closing the switching valve on the pressurized gas supply passage.

7. A cleaning and releasing device comprising:

a liquid tank for storing liquid;

a pump for pressurizing the liquid in said liquid tank to supply pressurized liquid;

a liquid supply passage for connecting said liquid tank to said pump;

an injection nozzle for injecting the pressurized liquid;

a pressurized liquid flow passage for connecting said pump to said injection nozzle;

a pressurized gas source;

a pressurized gas supply passage for connecting said pressurized gas source to said injection nozzle;

a switching valve provided on said pressurized gas supply passage;

a sensor provided on said pressurized liquid flow passage to detect supply and stop of the pressurized liquid from said liquid tank;

an operating portion disposed in said injection nozzle or on said pressurized liquid flow passage to thereby supply and stop the pressurized liquid; and a controller connected to said sensor and said pressurized gas supply passage, said controller detecting supply and stop of the pressurized liquid detected by said sensor to thereby control supply and stop of the pressurized gas from said pressurized gas supply passage to said injection nozzle based on said sensor;

wherein pressurized gas is supplied to said injection nozzle from said pressurized gas supply passage when said sensor detects the supply of the pressurized liquid from said liquid tank;

said device further comprising a powder and granular material tank connected to said pressurized gas supply passage, and supply and stop of powder and granular material is controlled by said controller based on the supply and stop of the pressurized liquid detected by said sensor; and wherein the controller controls the supply and stop of powder and granular material by stopping and starting operation of a drive motor connected to the powder and granular material tank.

* * * * *